US008215962B1

(12) United States Patent
Machado

(10) Patent No.: US 8,215,962 B1
(45) Date of Patent: Jul. 10, 2012

(54) WATERPROOF SWIVELING ELECTRIC CORD SLIP COUPLING CONNECTOR

(76) Inventor: Manuel Machado, Elk Grove, CA (US)

( * ) Notice: Subject to any disclaimer, the term of this patent is extended or adjusted under 35 U.S.C. 154(b) by 0 days.

(21) Appl. No.: 13/134,051

(22) Filed: May 27, 2011

(51) Int. Cl.
*H01R 39/00* (2006.01)
*H01R 13/52* (2006.01)

(52) U.S. Cl. ..... 439/18; 439/274

(58) Field of Classification Search ..... 439/13, 439/18, 21, 23, 24, 274, 275, 587, 594
See application file for complete search history.

(56) References Cited

U.S. PATENT DOCUMENTS 1,873,042 A * 8/1932 Rohrdanz ..... 439/18
3,185,951 A * 5/1965 Le Bean Lee ..... 439/26
3,243,860 A * 4/1966 Whittaker et al. ..... 425/84
3,297,973 A * 1/1967 Wendell ..... 439/26
3,355,695 A * 11/1967 Overesch ..... 439/31
3,564,168 A * 2/1971 Bigg ..... 200/8 R
3,860,312 A * 1/1975 Gordon, Jr. ..... 439/31
6,010,348 A * 1/2000 Alden ..... 439/274
6,494,731 B1 * 12/2002 Suzuki ..... 439/275
7,566,223 B2 * 7/2009 Wadsworth ..... 439/21
7,922,215 B2 * 4/2011 Salomon-Bahls et al. .... 285/339
7,946,852 B2 * 5/2011 John ..... 439/21
8,070,494 B2 * 12/2011 Li ..... 439/26

* cited by examiner

*Primary Examiner* — Chandrika Prasad
(74) *Attorney, Agent, or Firm* — William S. Bernheim

(57) ABSTRACT

A waterproof, swivel feature secondary plug and socket device suitable for use within a construction setting, for placement within an extension cord between an originating power source and a user end tool. The device allows a rotational movement between the plug and socket components such that cord twisting and buckling is eliminated, and strain on an operator is reduced. The device provides protection against cord damage or operator injury because, when too great a longitudinal traction force is applied along the cord, as when a cord becomes entrapped during use, the frictional fit between the plug and socket component allows an automatic separation of the unit with immediate withdrawal of electrical power from the cord.

3 Claims, 6 Drawing Sheets

WATERPROOF SWIVELING ELECTRIC CORD SLIP COUPLING CONNECTOR

BACKGROUND OF THE INVENTION

1. Field of the Invention

The device of the present invention relates generally to the class of electrical connectors referred to as a rotary coupling or a slip coupling.

More specifically, it refers to a device used in a process of:

(1) providing a reduction of a likelihood of a damage to an electrical cord and a reduction of a danger to a user during a use of a tool attached to that electrical cord while that cord is in a use in a work process within a commercial or a domestic setting;

(2) providing such reductions of damage and danger by a use of a waterproof, in-line swivel connector, also referred to as a secondary connector; which said secondary connector allows a transfer of an electrical current from an electrical source through at least one parent electrical extension cord that ends in a socket assembly component of that swivel connector and an electrical tool or device affixed at a terminating end of an end-tool cord, the originating end of which end-tool cord comprises a plug assembly component of the secondary connector of this invention.

(3) allowing of a degree of a frictional resistance between a rod shaped section of the plug assembly and an open cylindrical section of the socket assembly component of the device such that there is an existence of an adequate resistance to a separation of said slip coupling elements allowing of a full use of a tool for an intended use of said tool while still providing of an allowance and an ease of an uncoupling of said slip coupling elements when such a separation of said connectors is desired;

(5) further providing a cord damage prevention feature by virtue of a slip-coupling effect that allows of an automatic separation of the plug and the socket slip coupling elements when a force of a sufficient strength to overcome an inherent frictional resistance between the slip coupling elements is applied along a longitudinal axis of the cord; doing so without a damage to the electrical cords, and, following any dissociation of the plug from socket components, allowing of an ease of a re-establishment of a full circuit electrical current flow by a re-insertion of the plug component fully within the socket component of the device.

(6) providing an insurance against an excessive twisting and kinking of an electrical cord by virtue of an ability for a swiveling action brought about between said rod shaped and said socket shaped elements of said secondary connector, thus affording a protection against a damage to said electrical cord and a reduction of an excessive strain upon a user that would otherwise be developed by the excessive twisting and kinking of the cord.

(7) providing a simple and effective method and device for an at the job site repair of any parent electrical cord where a separation damage occurs along a length of that cord.

DESCRIPTION OF THE PRIOR ART

Swivel hinge and other swivel connector features have been developed to improve the ability to relocate tools and equipment and to allow electrical power cords to diverge from parent sources of electrical conductivity without imposing bending strains on the cords as they leave the electrical socket-plug source.

A major problem is that most require either complete disassembly in order to afford connection and disconnection of the end tool/machine from the parent electrical source, or have other features that make freedom of connection and disconnection difficult and unwieldy.

Some of the prior art inventions require the manufacture of complicated parts for their construction, thereby increasing costs and in most instances not providing the structural strength and flexibility needed to withstand the wear and tear associated with physical rigors and movements associated with the use of portable, hand held power tools in building construction projects and the like.

Most such devices provide strain relief on the cord only at the location of the originating electrical power outlet, do not provide a waterproof junction at the cord/swivel socket connection and do not provide a full range of rotation around a long axis of the electrical cord and the plug-socket assembly of their inventions.

SUMMARY

By and large, construction workers using tools such as hand held power saws, drills, screw guns and the like in building wood or steel frame buildings, shipbuilding other such construction processes have had to deal with using tools held at the ends of long and heavy cords and often have done so while having to work in precarious positions on lifts or beams; the present invention teaches hence an enhanced 360.degree, bi-directional swivel feature allowing of a release of a rotational tension on an electrical cord in order to create an ergonomic improvement and an enhanced safety for a worker using the tool; even fixed industrial manufacturing sites present special needs wherein a swiveling function can provide a protection against a damage to electrical cords and harm persons. Electrical cords have been subject to damage from other construction materials and objects, and even to breakage following entrapment while under extension; attempts to deal with this latter problem have involved the creation of plug-socket connectors that can break without harming the cord itself when an extension force of a sufficient magnitude is applied along the cord length.

Problem Areas and Rules and Regulations

Extension Cord (aka power cord) Safety: even properly made cords can be hazardous if misused or damaged, and the potential for fire, electrical shock or even electrocution is increased when defects exist.

In accordance with OSHA regulations, extension cords used in construction sites must be inspected periodically for proper grounding conductor integrity, or they must be protected by a GFCI. The Code of Federal Regulations ("CFR") 1910.303 states that electrical insulation shall be free from recognized hazards that cause death or serious physical harm to employees; and CFR 1910.334(a)(2)(ii)) requires damaged or defective power equipment to be removed from service until repairs are made and tests show the equipment is safe.

Missing ground prongs are a violation of Occupational Safety and Health Administration (OSHA) regulations and the National Electric Code. As required by CFR 1910.334(a)(3)(ii), attachment plugs and receptacles may not be connected or altered in a manner which would prevent proper continuity of the grounding conductor There are many ways that power cords can become frayed or damaged, including wear and tear from dragging on rough or sharp surfaces, and even pinching the cord between solid objects; an applied, strong traction force along a fully extended cord can cause a tearing of the cord's external protective sheathing or a detachment from the plug head, leading to an exposure of energized wires; as an example, a hard tug that stretches a cord that has become trapped in debris or between a man-lift and a fixed structure can damage the cord's insulation, sheathing, or, even lead to a breaking of the cord.

The National Electrical Code (NEC) requires that flexible cord "shall be used only in continuous lengths without splice or trip; and any cord that is frayed, cracked, or damaged should be replaced (with a cord of the same or larger gauge wire). Wrapping the cord with electrical tape or splicing flexible cords together is not acceptable.

Distinctions Between the Incident Invention and the Prior Art

Swivel features of differing sorts already exist for electrical plugs. But in general, the swivel connectors in current use are mostly suited for a limited swivel feature at an originating end of a cord. Opposed to this, the swivel connector of the current invention is designed for a use at a point somewhere along a length of a cord between an original plug into a power source and a terminal end at which a power tool or device of some sort is attached to the cord; in essence, the swivel feature of the current invention comprises a waterproof, in-line plug-socket swivel connector allowing of a maintenance of an electrical continuity between an original electrical source and an electrically powered device, while further allowing of an automatic separation and disconnection of the power tool from the electrical source under a condition wherein a danger of cord breakage or damage is brought to bear by an excessive stretching of the cord, or, a separation at a desire of an operator to make a separation of the tool from the electrical source for another reason; either such separation being accomplished without a damage to the cord elements and a full electrical conductivity being allowed along the electrical circuit from source to tool once the elements of the swivel connector are fully re-engaged.

U.S. Pat. Nos. 3,185,951; 3,564,168 and 3,297,973 all teach swivel features but all require either complete disassembly necessary in order to afford connection and disconnection of an end tool/machine from the parent electrical source, or have other features that make freedom of connection and disconnection difficult and unwieldy.

U.S. Pat. No. 3,243,866 teaches a miniature plug assembly that requires several complicated manufacturing steps for its creation and would not provide the structural strength and flexibility needed to withstand the wear and tear associated with physical rigors associated building construction projects and the like.

U.S. Pat. No. 1,873,042 teaches a swivel plug rotatable around a long axis of a cord with the swivel plug feature located at the electrical power source outlet; opposed to this, the current invention comprises an in-line interruption connector situated at a point somewhere between the originating power outlet source and the end tool.

Several U.S. patents, involve swivel features in association with a hinge feature, such as is used for car doors, etc.; U.S. Pat. No. 3,355,695 involves "metal tape" conductors rather than stripped wire end connectors; U.S. Pat. No. 1,744,040 provides only a 90.degree electrical connectivity across a door hinge element.

The closest prior art discovered was U.S. Pat. No. 3,860,312 (Gordon, Jr.) ("GORDON"), which, separately from, or in association with a hinge association feature, teaches a paired set of "elongate plug and socket elements" that create an electrical conductivity between an original power outlet source and an end point machine or tool. The connector allows repeated dissociation of the plug and socket elements without adversely affecting the electrical continuity when coupled (Front Page, Abstract).

As disclosed and taught, GORDON requires the complex fabrication of both the plug and socket sections of the connector. GORDON teaches a complex socket section assembly that requires the use of a series of specially fabricated "brushes" that are manufactured from a suitable "spring material" such as for example, "strip beryllium or copper" (Page 4, lines 5-7); and, those brushes must be " . . . suitably secured . . . " (Page 4, lines 13-15) to the ends of electrically conductive wires which are externally connected to an associated end tool element; the mode of making such suitable connection is not taught, however for example, as shown in FIG. 1 characters A to 40 to 27—it appears that the method involves a soldering action for each of the connectors; no waterproof interconnection between the plug and socket elements are taught in GORDON.

OPPOSED to the complexities and cost of GORDON's invention, as will be seen in the Detailed description section that follows, the current invention discloses and teaches a simple construction of a socket section of the current invention from common, inexpensive, commercially available parent materials.

GORDON's plug section, as disclosed and taught, involves attaching electrical wires to a series of electrically conductive " . . . slip rings . . . " by an untaught manner, perhaps soldering (?)—following which " . . . the conductor rings 14-17 and attached connectors B . . . " are placed within a " . . . mold and molding or vacuum casting . . . " is performed using a plastic non-conductive material to form the plug element—following which removal of excess plastic is necessary in order to form a surface such that " . . . the outer diameter of the rings (14-17) is substantially equal to the diameter of the non-conductive regions." (Page 4, lines 53-65).

The instant application, OPPOSED to the complex and labor intensive method taught by GORDON, as will be disclosed and taught in the Detailed Description section that follows, teaches a simple construction of a plug section of the current invention from common, inexpensive, commercially available parent materials.

No prior swivel plug, including GORDON, discloses or teaches a provision for a formation of a waterproof plug/socket junction that makes a provision of an uninterrupted non-metallic external surface of the component parts of the electrical circuit.

No prior swivel plug, including GORDON, discloses or teaches a provision for an automatic separation between the swivel plug and socket portions of a plug and socket device in the event of an occurrence of an entrapment of the cord that prevents any further extension of the cord;

No prior swivel plug, including GORDON, discloses or teaches a use of an attached tool in an ergonomically efficient manner by providing a rotational feature that allows of an automatic untwisting of a parent cord section in relationship to a tool borne end section of a cord, thereby making a provision of a reduction in a torqueing force that would otherwise be imposed on a person holding and using the tool.

The ergonomic advantage disclosed and taught as being made available by the full swivel feature of the device provides several advantages. When a long, heavy extension cord is powering a tool to which it is in a permanent affixation at a tool bearing end without a full swivel feature between the tool borne end and an originating plug end section, twisting and kinking of the cord impose unnecessary and fatiguing strains on a user's body as the user turns and moves in a manner allowing a use of the tool in a series of differing axial locations and heights of use; in the absence of a swivel feature, repeated twisting and kinking of cords has led to cord damage in the past.

As taught and disclosed in the instant application, when a long, extension cord is powering a tool to which it is in a permanent affixation at a tool bearing end a full swivel feature such as is taught in the instant application, by virtue of a type of contact ring used, leads to an increased freedom of rotation between the socket and plug elements, and therefore to a reduction of strains on a user's body as the tool is turned and moved for use in a series of differing axial locations and heights of use as well increased prevention of a twisting and kinking of the cord that can prevent cord damage such as has happened in the past in the absence of the swivel feature disclosed and taught in this invention.

Objects of the Invention

It is a primary object of this invention to provide and maintain an electrical conductivity within an electrical circuit by a use of a paired secondary plug and socket assembly as a component part of said electrical circuit in such a manner as allows of a complete rotational ability along a long-axis of and between a paired socket assembly component and a plug assembly component of such secondary plug and socket assembly;

which said plug and socket assembly components comprise an electrical coupling that, in and between themselves, provide for a creation of and a maintenance of a level of a frictional resistance between themselves providing an insurance against an unintentional separation of said components by a combined weight of an intervening primary cord section, in a combination with a weight of said secondary plug-socket assembly and an end user-tool and an end user-tool cord section during a use of said end user tool;

further providing, as a safety feature, an allowance of an automatic separation of said secondary plug and socket assembly components when an applied longitudinal force along a length of said components of said electrical circuit exceeds said frictional resistance of said assembly;

allowing thereby an interruption of said electrical circuit without a damage to any components of said circuit, and providing an allowance of an immediate re-establishment of said electrical conductivity within said circuit once an overstretching of said components of said circuit is eliminated and said secondary plug components are again brought into a fully paired engagement.

Another object of this invention is to provide a waterproof and non-metallic external surface as an essentially, shoulderless, tubular conformation along a continuum of component parts of an electrical circuit; said conformation leading to a reduction of a likelihood of an accidental disengagement of said secondary socket components as said component parts of said electrical circuit are moved within a work environment and brought into a contact with surrounding objects;

which said electrical circuit components comprise: an originating electrical source outlet; a parent-cord plug in a situation within said source outlet; said parent-cord comprising at least one electrical extension cord of a possible series of such cords; a terminal end of said electrical circuit comprising an end-user tool in a situation at a termination of an end-tool cord section;

said parent cord or cords terminating in a modification as a socket end of said secondary plug and socket component of this invention;

said end-tool cord section further comprising an origination as a modification of said end-tool cord to form said plug end of said plug and socket components of the current invention.

DETAILED DESCRIPTION OF A PREFERRED EMBODIMENT

Figure 1A:
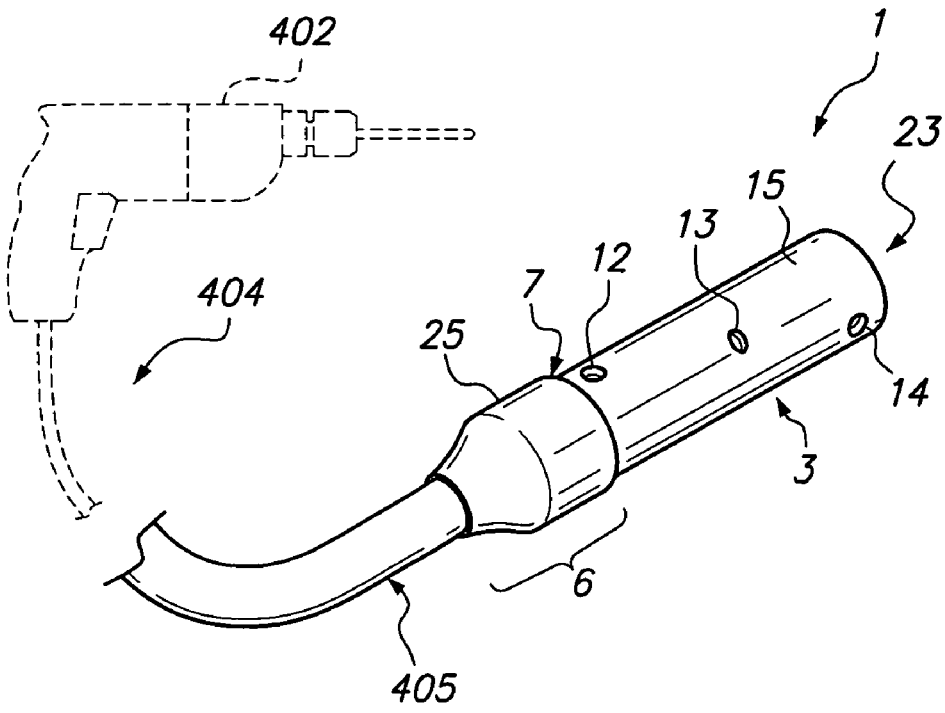
FIG. 1A: Provides a diagrammatic representation of an end user-tool, an end user-tool cord and an origination of said cord as a plug component of a socket and plug assembly of a device disclosed and taught as a secondary plug and socket connector within an electrical circuit.
Figure 1B:
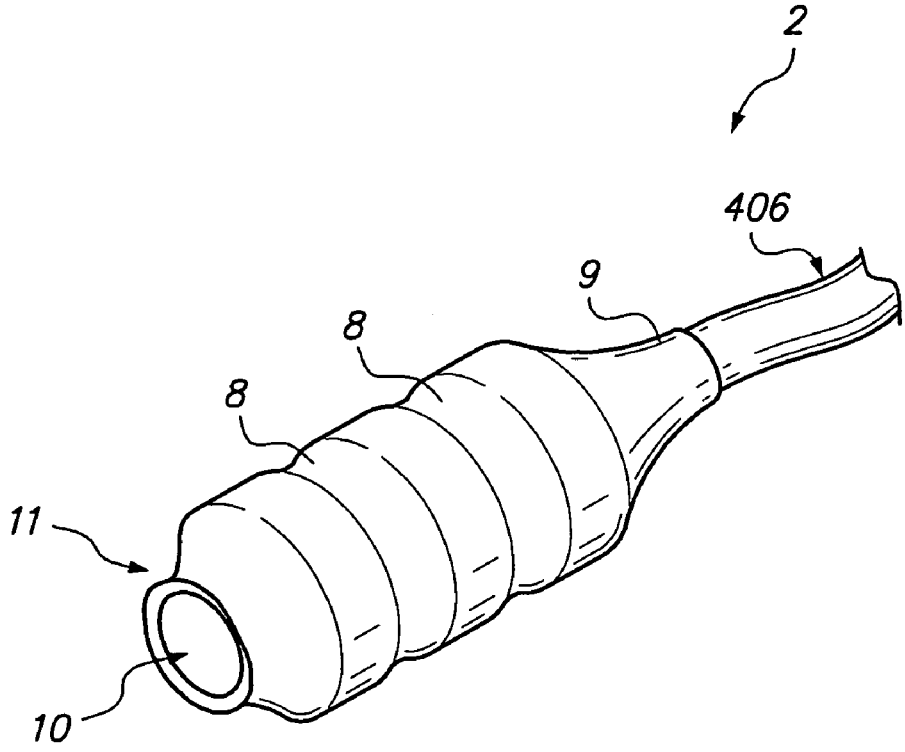
FIG. 1B: Provides a diagrammatic representation of a socket assembly component of a secondary plug and socket connector for a use within an electrical circuit.
Figure 1C:
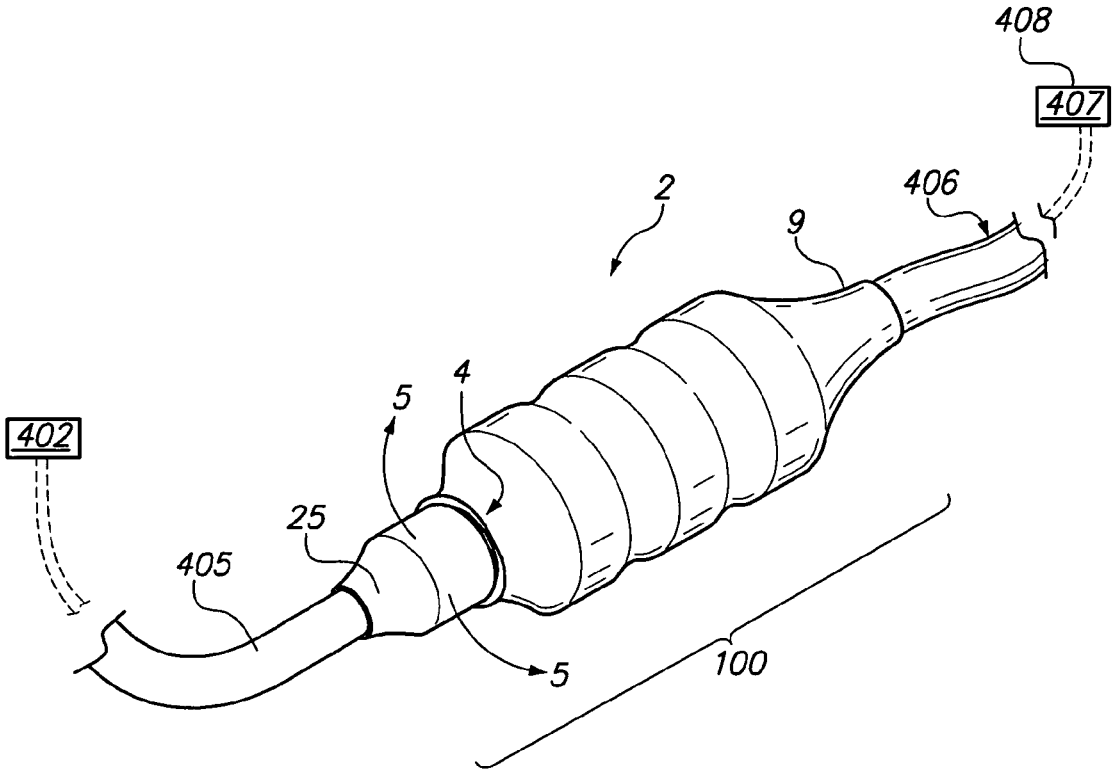
FIG. 1C: Presents a side view of a completed interconnection of a plug assembly component and a socket assembly component of a secondary plug and socket connector for a use within an electrical circuit as taught in this application.
Figure 4:
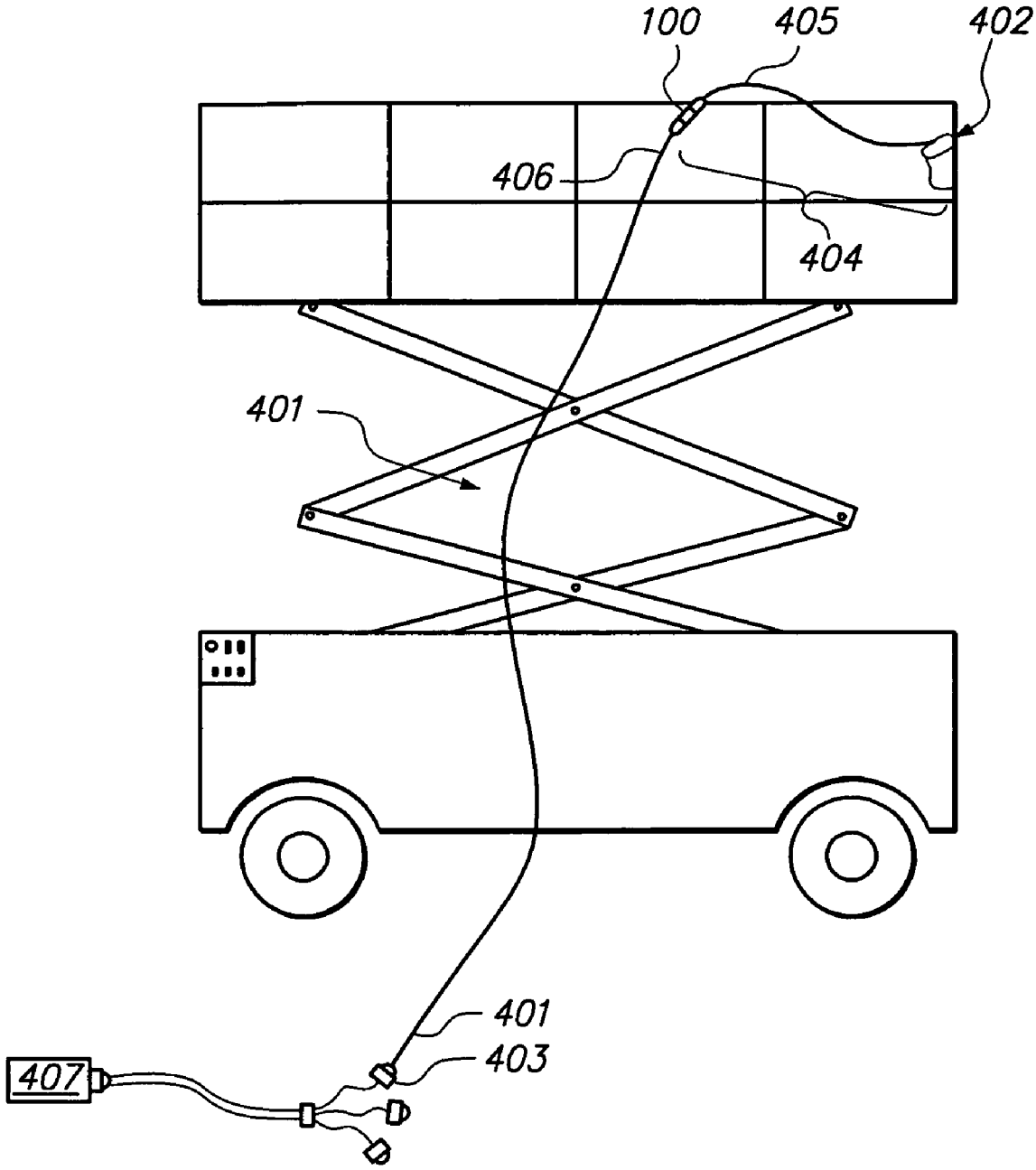
FIG. 4: Presents a non-scalar, diagrammatic representation showing one of a possible scenarios of a use of the device of this invention in a construction related work environment.

The present invention comprises a device 100 FIG. 1*c*, aka: a secondary socket and plug connector in a situation within a series of components of an electrical circuit; said device allows in concert with other elements of said circuit, a provision of a full flow of an electrical current within said electrical circuit;

said electrical circuit further comprising an originating electrical outlet power source 407 FIG. 4; a continuation of said circuit proceeds on from an originating plug end 403 FIG. 4 of at least one parent extension cord 401 FIG. 4, and said parent extension cord or cords terminating in a modification as a socket assembly element 2 FIG. 1*b* of said secondary socket and plug component; a plug assembly element 1 FIG. 1*a* of said secondary plug and socket component, comprises a modification of an origination end 405 FIG. 1*a* of an end-tool electrical cord 404 FIG. 1*a*, which said end-tool electrical cord section allows a provision for a continuation of said flow of said electric current in said circuit following which a termination end of said end-tool cord in a permanent affixation within a user end-tool 402 FIG. 1*a* allows of a process of a use of said end tool in and for any intended use of said tool;

General Description of a Preferred Embodiment

A preferred embodiment as taught, comprises a presentation of component parts of a paired socket and plug assembly suitable for a use with an extension cord; which cord comprises a set of at least two, preferably three 16 gauge wire components, each of which wires are in an individual insulation within an insulating, external covering of said cord; said component parts of said assembly being of a size suitable for a use with a cord comprising said sized components; one knowledgeable in the art and skilled in the field will recognize that based on a specified need of a greater or lesser diameter cord size, a modification of size of components may be made to the disclosed embodiments.

The Socket Assembly

Figure 2A:
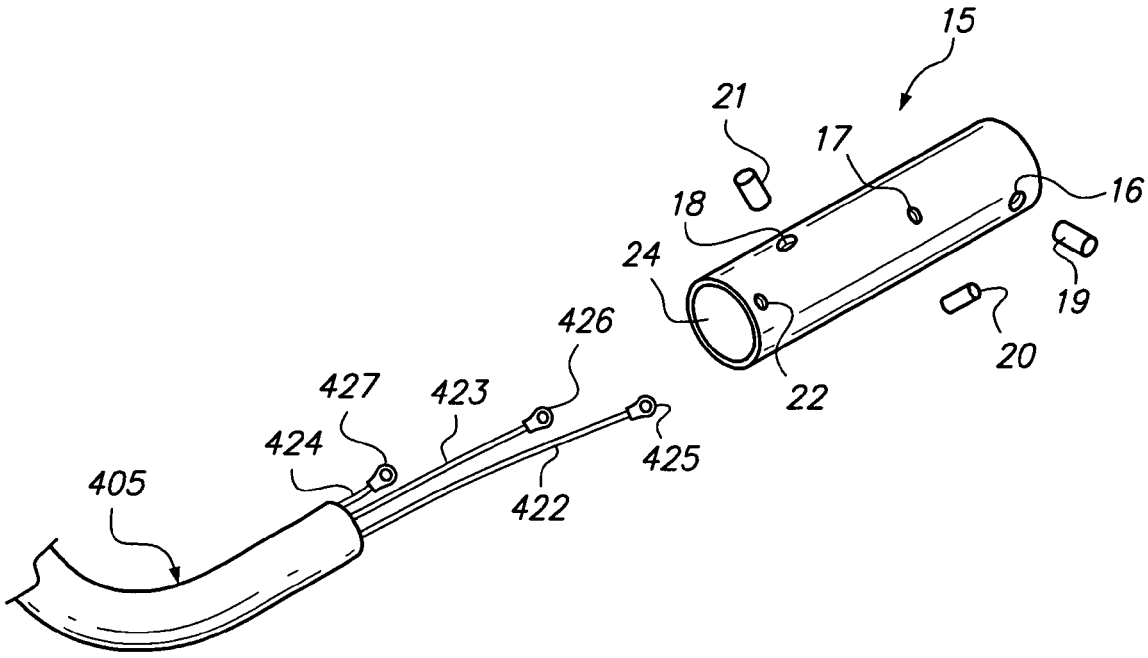
FIG. 2A: Presents an exploded view showing all but one of the component parts of a plug assembly component of a secondary plug and socket connector circuit as taught in this application.
Figure 2B:
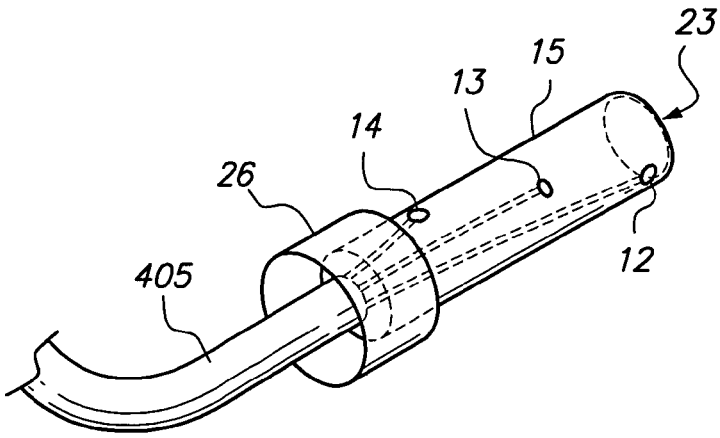
FIG. 2B: Presents a side view of the now interconnected parts that are seen dissociated in FIG. 2A; plus showing a section of shrink wrap in a relation to those other component parts prior to a shrinking of the wrap to complete an interconnection of the components to form a plug assembly component of the user end-tool cord as that was seen in FIG. 1A.
Figure 3A:
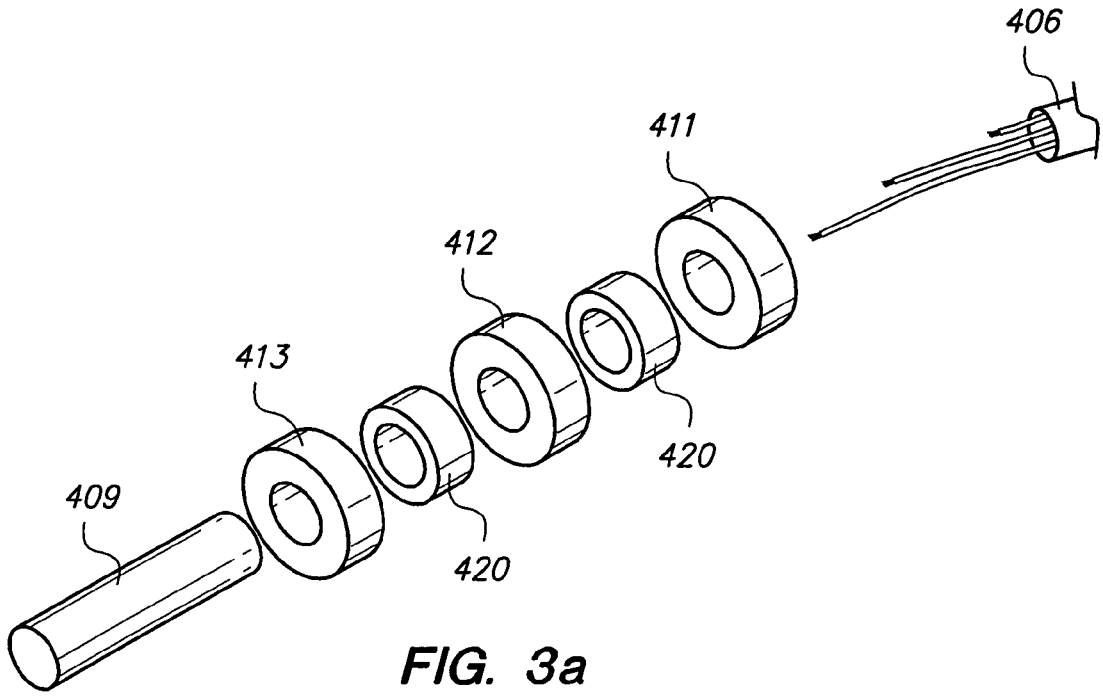
FIGS. 3A-D: Provides a serial representation of the components of the socket assembly from a dissociated stage to a final view with the shrink wrap represented in relation to the balance of the assembly components prior to a shrinking of the wrap to form a completed assembly as that was depicted in FIG. 1B.
Figure 3B:
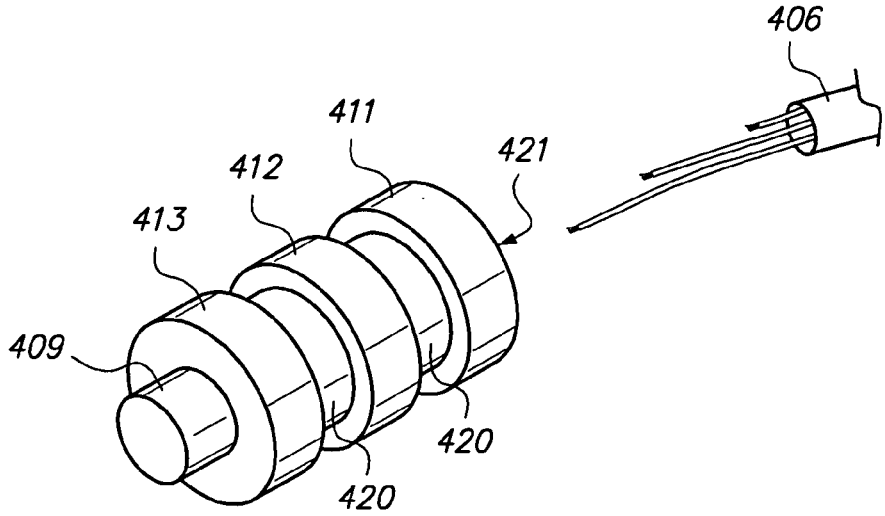
Figure 3C:
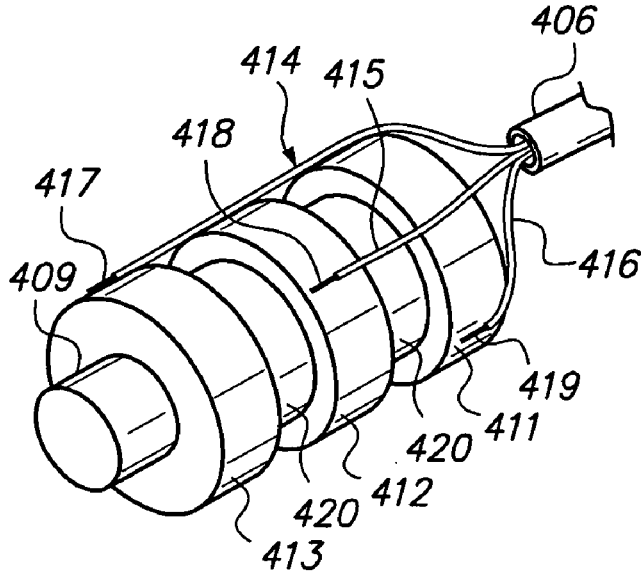

A basic component of said socket assembly comprises a series of at least three, ring shaped electrically conductive contact elements, in a preferred embodiment comprising a set of needle bearings; a hot wire lead contact ring 413 FIG. 3*c*, a neutral wire lead contact ring 412 FIG. 3*c*, and a ground wire lead contact ring 411 FIG. 3*c*, which said contact rings serve as a set of electrical contact points within said socket assembly;

metallic conductor rings are know in the prior art, and in the current invention said conductive rings may comprise, as described following as a preferred embodiment, a set of needle bearings; or, in an alternative embodiment, conductive rings selected from the group consisting of non-threaded, tubular shaped, copper fittings, copper tubing, steel tubing, steel fittings;

in addition to said electrically conductive metallic ring components, said socket assembly further comprising an essentially tubular, rigid outer shell 8 FIG. 1*b* comprised of a non-metallic, non electrically conductive heat moldable material; which said rigid outer shell as well comprises a definition of a full length and an external diameter of said socket assembly including an origination of said outer shell 9 FIG. 1*b* as a covering overlapping and rigidifying a connection with an insulated, termination end 406 FIG. 1*b* of said parent electrical cord(s);

a longitudinally arrayed series of at least three insulated electrical wires 414, 415, 416 FIG. 3*c*, an insulated portion of a hot lead wire of said parent cord 414 FIG. 3*c*, an insulated portion of a neutral lead wire of said parent cord 415 FIG. 3*c* and an insulated portion of a ground lead wire of said parent cord 416 FIG. 3*c* extending forward from said parent cord with an external most aspect of each of said wires being in a situation in an immediate contact with an inner aspect 10 FIG. 1*b* of said rigid outer shell; a bare, terminal end 417 FIG. 3*c* of said hot lead wire 414 being in a contact with said hot lead contact ring 413 FIG. 3*c*, providing thereby of a hot lead continuity for said flow of electrical current from said socket element into said plug element; a bare, terminal end of a neutral lead wire 418 FIG. 3*c* being in a contact with said neutral lead contact ring 412 FIG. 3*c*, providing thereby of a neutral lead continuity for said flow of electrical current from said socket element into said plug element; and a bare, terminal end of a ground lead wire 419 FIG. 3*c*, 414 being in a contact with said ground lead contact ring 411 FIG. 3*c*, providing thereby of a ground lead continuity for said flow of electrical current from said socket assembly into said plug assembly element;

each of said bare terminal ends lying respectively in a separate, and immediate contact atop one of said series of electrically conductive contact rings 413, 412 and 411 FIG. 3*c;* said hot lead contact ring 413 being in a terminal situation, nearest a terminal, open end lock-seal element 11 FIG. 1*b* of said socket;

said terminal location at said lock-seal end providing a worker safety protection in that that any separation of said plug from said socket resulting in a disengagement of said hot wire contact ring 413 from a contact with a corresponding hot wire contact point 12 FIG. 1*a* of a rod shaped element section 3 FIG. 1*a* of said plug element, results in an immediate withdrawal of a full electrical current flow from said circuit;

and, said neutral lead contact ring 412, arrayed at an approximate mid point along said length of the socket, is withdrawn from an existing contact with a neutral lead contact point 13 FIG. 1*a* of said rod shaped element following said separation of said plug from said socket;

likewise, said ground lead contact ring 411, arrayed at a position adjacent to but slightly short of said origination end 9 FIG. 1*b* of said outer shell, is withdrawn from an existing contact with a ground lead contact point 14 FIG. 1*a* of said rod shaped element following said separation of said plug from said socket;

a full length of said socket section being comprised by a full length of said rigid outer shell from a starting point at said rigidifying origination end 9 adjacent to said termination end 406 of said parent cord, forward to and including said lock-seal end 11 of said socket assembly;

said contact rings, 411,412,413 being in a longitudinal array within a length of said outer shell, each of said contact rings being held in a separation from its adjacent member by a ring shaped, non-electrically conductive spacer; 420 FIG. 3*c;* said internal aspect of said terminal, lock-seal section of said rigid outer shell being of a diameter equal in dimension to an internal diameter of said contact rings and of said non-conductive spacer sections; forming thus an internal cavity of a uniform diameter along a length of said outer shell from its said termination section to a rearmost aspect of said ground lead contact ring 421 FIG. 3*b;* said internal diameter of said socket section being of a dimension and a form allowing of a snug but non-fixed fit around an external dimension and form of a full length of said rod shaped element section of said plug assembly;

The Plug Assembly said snug but non-fixed fit between said internal aspect of said socket and said external aspect of said rod shaped element creating a provision of a full 360.degree rotational ability in either direction around a long axis plane of said paired socket and plug assembly components of said device 100 FIG. 1*c;* an origination section 6 FIG. 1*a* of said plug assembly comprising a section of heat shrunk heavy gauge shrink wrap 25 FIG. 1*a*; said wrap being in a situation overlapping and creating a stiffening reinforcement of said origination section 405 of said end-tool electrical cord and ending as a terminal end section 7 FIG. 1*a* on said rod shaped element;

said origination end of said tool-end cord, aka a plug end section of said cord terminally comprises a set of at least three insulated electrical wires, each of said wires having a bare end affixed in a crimped on manner into a bolt-hole ending electrical connector; a hot lead wire 422 FIG. 2*a* with its said affixation within an associated electrical connector 425 FIG. 2*a*; a neutral lead wire 423 FIG. 2*a* with its said affixation within an associated electrical connector 426 FIG. 2*a*; a ground lead wire 424 FIG. 2*a* with its said affixation within an associated electrical connector 427 FIG. 2*a;* a tubular, electrically non-conductive outer shell element 15 FIG. 2*a* of said rod shaped element of said plug assembly, having a set of at least three through and through contact plug holes, a hot lead contact plug hole 16 FIG. 2*a*, a neutral lead contact plug hole 17 FIG. 2*a*, and a ground lead contact plug hole 18 FIG. 2*a*; said holes being in a respective situation for a receiving of a set of at least three contact plug elements of said rod shaped element, a hot lead plug element 19 FIG. 2*a*, a neutral lead plug element 20 FIG. 2*a* and a ground lead plug element 21 FIG. 2*a;* a drain hole 22 FIG. 2*a* in said outer shell element 15, serving as a relief port for allowance of an escape of air as a material of a suitable, initially flowable filler material is flowed or injected into said outer shell; following which, a solidification of said flowable material leads to a completion of a non-conductive, solidified core section 23 FIG. 2*b* of said rod shaped element, which solid core section; preceding such flowing of said plastic material to form said rod section core, following a passage of said terminal bearing wires 422,423, 425 into an origination opening at an origination end 24 FIG. 2*b* of said outer shell 15, said terminal ends 425,426,427 are brought into a respective alignment with said plug holes 16,17,18 and individually brought into a rotational alignment such that following a passage of said contact plugs, 19,20,21 through a first side wall hole of said outer shell, said plug can make a passage thorough said bolt hole connector of said wire, and thence make a final passage into and through an opposed side bolt hole, creating thus a set of attachments of said hot, neutral and ground wires 422,423,424 with said contact plugs 19,20 and 21;

a suitable length of an un-shrunk heavy gauge shrink wrap tube 26 FIG. 2*b* is next brought into an alignment over said outer tube origination end 24, with a section of said shrink wrap tube forming a projection back over said origination end of said tool-end cord 405, and, while a firm traction of said cord 405 away from said tube 15 is maintained, said shrink wrap material is heated and shrinks to form said origination section of said plug assembly as seen at 6 FIG. 1*a;* said suitable flowable filler material is poured or injected into said tube, until such time as an extrusion of some of said plastic material appears at said drain hole 22 as an indicator of a filling of said internal aspect of said outer shell, following which said flowable material is allowed to harden and form said solid core section 23 FIG. 2*b;*

Special Lubricants Commonly Used in the Device

A use of a special electrical contact lubricant such as SpeedX (a product of the Corrosion Technologies Corporation), or, of a product such as Clear Glide (a product of Ideal Industries, Inc.) advertised as an easy clean up lubricant material suitable for a use in all electrical commercial and domestic plugs is advised as part of the use of the device;

these materials provide an ease of assembly and disassembly as well as an improved rotational ability of the socket and plug components without overcoming the frictional adhesion created by the snug fit of the rod shaped component into the socket element of the device;

they further provide an improved resistance to the entry of water at the juncture of the terminal lock-seal section of the socket with the terminal end of the of the origination section of the plug element;

Special, Safety Providing Features of the Invention—Stable Connection: with an Automatic Separation Feature in an absence of said slip coupling feature of said device, an entrapment of said extension cord by construction debris, or under the tires or other sections of man-lifts and like obstructions, when maneuvering while a user is holding an attached end user tool, can lead to a tension created by said cord such that said man-lift can be over, leading to operator injury and damage to the lift;

when said plug and socket components of said device are brought into a fully paired engagement, a frictional adherence is created by a snug but non-fixed fit between an external surface of said rod shaped member of said plug component and an internal surface of said socket member of said plug component, said frictional adherence creating a level of a frictional resistance of a strength adequate for a prevention of a separation of said socket and plug elements, while still affording a provision of an allowance for a full 360.degree rotation of said plug within said socket along a long axis of said device;

thereby allowing of a full range of use in differing positions, levels and angulations of said end tool for any intended use of said tool while still providing of an allowance and an ease of an uncoupling of said slip coupling elements when such a separation of said connectors is desired.

Waterproof Seal

Construction workers in a wide variety of commercial construction projects use electrical tools in areas where some moisture is present in a form as pooled ground water following rains or following an application of water as a dust prevention; a water mist may also be present on certain occasions such as when a stuccoing operation or other such processes are in use; extension cords may be dragged through or suspended within an area of such a subjection to such moisture conditions;

following a placement of said rod shaped member into a fully paired engagement within said socket assembly component such that a non-metallic full external covering of said socket component and a non-metallic external covering section of said plug component section are brought into an abutting approximation as depicted at 4 FIG. 1*c*, allows of a formation of a waterproof seal in said secondary plug and socket connector, while still allowing of a full 360.degree potential of a rotational movement in either direction around a long axis plane of said secondary connector between said plug and said socket components, as such rotational freedom is indicated by a pair of arrows 5 FIG. 1*c;*

Swiveling Slip Coupling Provides Both Cord Protection and Ergonomic Improvement Said swiveling slip coupling feature of said device creates a further provision for a reduction of a likelihood of a damage to said at least one parent electrical cord 401 FIG. 4 as well as a provision of a reduction of a danger to a user during a use of said user end tool 402 FIG. 4 attached to said parent electrical cord while that cord is in a use in a work process within a commercial or a private setting;

an automatic occurrence of a separation of the plug and the socket components when a tractioning force of a sufficient strength to overcome said frictional resistance created by said snuggly fitting coupling elements is applied along a longitudinal axis of said parent and tool-end cords (401 and 402 FIG. 4 respectivelly), creates a provision of said cord damage prevention feature as well as a provision of said worker safety improvement feature by virtue of said slip-coupling effect of said device as such separation of said components removes an overly strong tractioning force along said cords of said electrical circuit, and, removes an upsetting force that might otherwise effect said falling of said and tool user;

Said swivel feature further providing a reduced danger of a damage to the cord(s) due to a twisting or a buckling of the cord(s) during use, and, at the same time leads to a reduction of strains on the user that might otherwise be brought into a play when said cords become twisted and buckled.

Ease of Fabrication of the Device

Figure 3D:
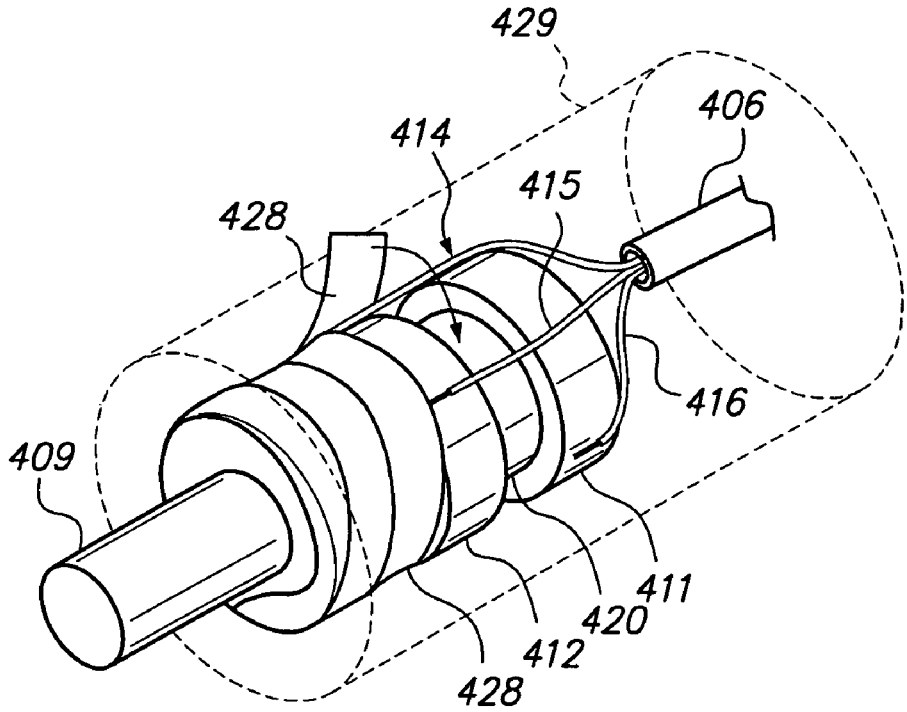

Fabrication of the socket assembly component of the device simply involves a stripping of an end section of a series of at least three insulated wire sections at a terminal end of a parent cord originating at an electrical outlet source;

which bare wire end sections are then individually placed and temporarily held in place by a section of electrical tape 428 FIG. 3*d* atop a series of at least a set of three separate contact rings arrayed along a mandrel 409 FIG. 3*c*, with a set of non-electrically conductive sections 420 FIG. 3*c* separating the contact rings;

following which, an non-shrunk section of a shrink wrap tube material 429 FIG. 3*d*, of a suitable gauge of thickness, is placed around a length of the arrayed wires, contact rings and spacers, extending at a terminal, open socket end a short distance forward of the forward most end of a terminal, hot lead contact ring, and extending back behind those arrayed components along a portion of the insulated, terminal end of the parent cord, following which a heat activation leads to a shrinking of the wrap material and a removal of said mandrel 409 leads to a finalization of all the interconnected components of the array within a complete, rigid and socket element.

Fabrication of the plug assembly component of the device is accomplished by simply affixing bolt-hole ended terminal crimp connectors onto a set of at least three bare wire ends of a cord originating from an electrical tool affixed in a permanent connection to an end-tool cord, following which the end-tool cord wires with their respective connectors are inserted into a non-conductive tube of an appropriate internal diameter made of a plastic or like material in which tube at least three holes have been drilled through and through at a central radius and at an appropriate separation and location along the length of the tube;

the bolt holes of the three connectors are then individually aligned with a separate one of the three holes in the plastic tube, and an electrically conductive plug of an appropriate length to afford a penetration through the plastic tube and the aligned bolt holes of each of the terminal connectors is inserted;

typically said plug comprises a wire of an appropriate diameter and length to afford a passage through the plastic tube such that the ends of the plug are at or slightly proud of the external most surfaces of the plastic tube;

a shrink wrap material tube of a heavy enough gauge of thickness is placed in a situation such that the shrink wrap tube covers a portion of an origination end of the end-tool cord as well as a section of the wires of the array ending just short of the forward most aspect of a ground line contact ring, and just forward of a small drain hole in the outer shell tube, following which, with a longitudinal, separating traction force being applied along the length of the tool-end cord and the components arrayed along the central plastic tube, heat is applied and the wrap is shrunk, coming to a solid and rigid form along a length of said enclosed array of electrical components and the enclosed plastic tube; the shrunken wrap thereby leading to a formation of a bottom seal and a rigid shell base end of the plug section, with a rod shaped section, in a conformation with an external circumference of the plastic tube being in a projection forward from the rigid shell base section;

a suitable, flowable material is then flowed or injected into the tube to fill it until some of the flowable material is seen to exit the drain hole, following which the flowable material, with the tube filled to the top end, is allowed to solidify, completing a solid rod shaped section of the plug assembly;

the conductive wire ends projecting outside the plastic tube may, as needed, be lightly filed or burnished to make them flush with the outer diameter of the tube; the plug section is thus made ready for use.

Discussion of Tested Resistive Forces of the Device

The disclosure has indicated that the invention creates a device in which a maintenance of a cohesion between the socket and plug elements of the device is of a strength adequate for a full use of an attached end tool at an end of a construction grade extension cord and doing so at an elevation such that a parent electrical cord is in a vertical suspension significantly above a ground level of an origination of an electrical circuit in which is the device is in a use as an interposed, secondary plug and socket assembly within that circuit.

Testing has been performed to establish a level of a tractioning force necessary to create a separation of the socket and plug elements of the device while in such a usage.

Test System One

A first test system involved:

a vertical situation of the device with a stabilization of the plug component in a superior relationship to the socket element; following which a series of weights were placed in an affixation to the base of the dependent socket section of the device.

An addition of weights within a range of 10-12 pounds were found to create an over-tractioning that leads to a separation of the plug and socket.

Test System Two

A second test system involved:

A horizontal alignment of the device with a plug end of the device secured to a spring loaded force gauge and a socket end of the devise stabilized against traction motion.

A gradual and steady horizontally directed tractioning force was applied until the plug and socket elements were separated.

The separation, once started was quick and complete.

The range of force needed over a series of trials was 9-12 pounds.

Experience in Usage in a Construction Environment

1. NO SEPARATION of the secondary socket and plug elements of the device was brought about when:

a hand held Hilti Model SD 4500 screw gun, weighing approximately 2.5 pounds pounds, and being in an affixation as the end-tool at a terminal end of a fifty foot (50') construction grade extension cord itself weighing 2.5 pounds, for a combined weight of 5 pounds for cord and tool; with a user holding on to the screw gun then operating a man-lift and raised the tool-cord in combination to a suspended height of 40-50' feet above ground level.

2. AN AUTOMATIC SEPARATION of the plug and socket elements of the device happened when:

With a screw gun as an end-tool and an end-tool cord section tied off at the upper guard rail of a man-lift, and, the device in use as an in-line secondary socket and plug connection; and, the man lift being moved by an operator who had failed to notice that the parent cord extending up to the man-lift section was looped into a path of a wheel of the man-lift main frame such that forward movement of the main-frame resulted in a traction force sufficient to cause an automatic, unintended separation of the parent cord from the tool-end cord without a damage to either the parent cord, the tool-end cord, or danger to the end-tool user up on the man lift section.

Waterproof Safety Testing

A completely engaged pairing of a socket element and a plug element of the device, in a pairing as a secondary socket and plug connector within an electrical circuit, with the electrical circuit in an origination at a GFCI protected originating power source, and a parent cord and tool-end cord being brought into a conjunction by the socket and plug elements of the device, and with a termination of the circuit at a screw gun tool: was tested for an ability to undergo a full underwater immersion of the secondary socket and plug of the device while the screw gun was held in an operating mode by tieing off the trigger in a full-on power position.

The screw gun was allowed to operate in this manner with the device fully submerged in water for a period of 15 minutes.

The GFCI was not tripped; and, subsequent separation of the plug and socket components, after careful drying of the external aspect of the device before separation, showed no evidence of liquid on the rod shaped section of the plug element and no evidence of liquid entry within the end-seal section of the socket element.

It is not proposed that the device be used as a connector in a full water immersion usage such was used in this test. However, this test serves as proof of an extreme resistance to an entry of water of the device in any common and expected usage within a commercial or a domestic construction environment such as are taught for this device in which construction applications an occasional contact with pooled water or mist sprays from other construction applications in progress might be encountered.

Other Aspects and Conditions for Use

The most common usage as taught in this disclosure for a construction in a commercial or a domestic setting involves a use of an extension cord having three, individually insulated 16 gauge wires within the cord's external insulation, and such a cord was used in all testing instances provided as part of this disclosure.

However, there are instances where a lighter or a heavier gauge cord may be indicated for a particular usage in which a slip coupling might be needed; in such instances, there would be no alteration necessary in the device as taught other than a use of components of a greater or a lesser diameter or circumference as would be necessitated with a usage involving the diameters and circumferences of an involved set of parent wires.

Discussion of Selection of Type of Ring Conductor

Needle bearings, aka needle roller bearings, use small, cylindrical rollers set within a ring shaped framework in such a manner that the rollers provide a reduction of a surface friction between two opposed, rotatable contact surfaces.

A use of needle bearings was specifically described as a preferred embodiment in this application because a type of contact surface interface providing an increased ease of rotation of the rod element within the socket element is of a critical nature in a provision of a swivel feature as an element contributing to a reduction of a strain on a user as an improvement of an ergonomic consideration in a use of an end-tool being used.

However, in some specific instances, a provision of a slip coupling function in concert with a less easily rotational component of action may be indicated; in such cases, where a rotational ability of the slip coupling is of a less important nature, a series of less expensive and less rotatable ring shaped components of a socket section of said device can be used instead of the needle bearings used in the preferred embodiment disclosure section of this application;

For a domestic use with an electrical mower, as well as an electrical hand held trimmer and an electrical hand held yard blower device; a ring shaped copper element cut from an electrical tubing copper fitting was a ring material of choice in such fabrications.

An Alternative Embodiment

It is possible to enjoy the benefits of the device of this invention by a use within a large scale manufacturing assembly of a secondary plug and socket device for a use within an electrical circuit.

As an example, a socket assembly element can be manufactured by a use of a prefabricated, electrically non conductive outer shell, said prefabricated shell comprising in part, a pair of opposed sections of a non-metallic, non-electrically conductive material;

a base element section and a top element section; said base element of said pair of sections further comprising, a pair of integral non-electrically conductive ring shaped spacer elements; each of said spacer elements having an internal bore opening of a diameter equal to an internal bore diameter of a set of three ring shaped electrical conductor elements, and each of said spacers being at a separation one from the other and in a location within a length of said outer shell base element such that said electrical conductor elements are situated in a placement at an appropriate separation, and, an internal bore of said spacers and conductor elements comprising a continuous inner opening of a uniform diameter within a length of said socket element;

and, each of said integral spacers, by virtue of integral channels therein, allowing a provision for a passage of a set of three separate electrical wires, which said wires make said passage from a terminal end of a parent extension cord;

said base and top shell elements further comprising an origination end reinforcing section allowing of a firm and water proof fit and seal of said shell upon and around said terminal end of said parent electrical cord;

a terminal end-lip projection of said combined shells, comprising in part an internal opening of a same diameter as said conductor rings and said spacers of said combined shells, serves as a provision of a terminal waterproof seal end of said socket assembly;

an internally facing projection within each of said shell elements serving as a stop piece for a support of a top portion of an origination end of a hot lead wire conductor ring; said spacers further affording a provision of a support of a neutral lead wire conductor ring and of a partial provision of a ground lead conductor ring, which said ground lead conductor ring is afforded a terminal end support by said end-lip section formed by said shell elements;

said electrical conductor elements being individually and separately in an affixation to said set of electrical wires, a hot lead wire, a neutral lead wire and a ground lead wire;

a sealing together of said base and top outer shell elements serving to provide a completion of an electrically conductive socket component, which when brought into a full conjunction with a plug assembly component of said device, which said plug assembly can also be fabricated by a method similar to that described immediately prior for said socket assembly, leads to an ability to provide all the stated benefits and functions taught and described for the preferred embodiment as taught in this disclosure.

Although some exemplary embodiments of the invention have been described above by way of example only, it will be understood by those skilled in the field that modifications may be made to the disclosed embodiments without departing from the scope of the invention, which is defined by the appended claims.

I Claim:

1. A device comprising an electrical slip coupling, which said slip-coupling comprises a secondary socket and plug component within a series of components of an electrical circuit;

a socket assembly section of said secondary socket and plug comprising a modification of a terminal end of at least one parent extension cord, a plug assembly section of said secondary socket and plug component comprising a modification of an origination end of an end-tool electrical cord, which said end-tool cord at a termination is in a permanent affixation within a user end-tool;

said socket assembly comprising an essentially tubular, rigid outer shell comprised of a non-metallic, electrically non-conductive heat moldable material, with said shell comprising a definition of a complete length and external diameter of said socket assembly from an origination end as a covering overlapping and rigidifying a connection with an insulated end of said parent electrical cord(s), to a termination of said outer shell as an open end lock-seal element of said socket assembly;

after an extension forward from said parent cord a longitudinally arrayed series of at least three insulated electrical wires are found in a situation in an immediate contact with an inner aspect of said outer shell, with a bare, terminal end of each of said wires lying separately in an immediate contact atop one of a series of longitudinally arrayed, ring shaped electrically conductive contact elements; which said ring shaped electrically conductive elements are held in a separation from each other by a pair of electrically non-conductive ring shaped spacers;

such arrangement creating a contact of a bare hot lead wire with a hot lead contact ring, a contact of a bare neutral lead wire with a neutral lead contact ring, and, a contact of a bare ground lead wire with a ground lead contact ring;

said hot lead contact ring being in a location nearest said lock-seal element end of said socket; with said neutral lead contact ring element being in a situation as a most centrally situated conductive element and said ground lead contact ring being in a location nearest said origination section of said outer shell of said socket;

said situating of said ring shaped electrically conductive elements providing a worker safety protection feature by virtue that any separation of said plug from said socket creating a disengagement of said hot wire contact ring from a contact with a corresponding hot wire contact point of a rod shaped element component of said plug assembly results in an immediate withdrawal of a full electrical current flow from said circuit;

an internal aspect of said socket section comprises an internal cavity of a uniform diameter and along a length of said outer shell from its said terminal lock-seal opening to a rearmost aspect of said ground lead contact ring; said internal diameter of said socket section being of a dimension and a form allowing a snug but non-fixed fit around an external dimension and form of a full length of said rod shaped element component of said plug assembly;

said snug but non-fixed fit between said internal aspect of said socket and said external aspect of said rod section creating a provision of a full 360.degree rotational ability in either direction around a long axis plane of said paired socket and plug assembly components;

an origination end section of said plug assembly comprising a section of heat shrinkable heavy gauge shrink wrap material in a situation overlapping and creating a stiffening reinforcement of a section of said origination end of said tool-end electrical cord, a termination end of said shrink wrap further comprising an extension around a portion of said rod shaped element;

following an entry into a core section of said rod shaped element from an origination end of said end-tool cord, a set of at least three insulated electrical wires, each in a separate termination with a bolt hole ended crimp connector affixed on an insulation free end, is brought into a separate, fixed conjunction with one of a set of at least three double ended electrical contact plug elements of said rod shaped member; following which, said wires and said contact elements are held in an embedded location within a non-conductive core section of said rod element; said core section comprising a flowable material that was poured or injected within a non-electrically conductive tubular outer shell of said rod shaped section; after which, a solidification of said flowable material leads to a completion of a non-conductive, solidified core section of said rod shaped element;

said rod shaped element being of a length such that when a terminal end of said rod element is brought into a fully paired engagement within said socket assembly, said series of at least three, individual, double ended electrical contact points, of said rod shaped element, are placed into a contact against one of said contact rings of said socket assembly;

with said rod shaped element in said fully paired engagement within said socket assembly, said terminal, lock-seal section of said socket assembly is held in a moveable but stable abutting approximation against said termination end of said origination section of said plug assembly;

which said abutting approximation provides a waterproof seal at said approximation of said socket and plug components of the device, even when said components are being moved in said full 360.degree rotational manner in either direction around a long axis of said paired socket and plug assembly components;

said provision of a full 360.degree rotational ability in either direction around said long axis of said paired socket and plug assembly components creates a provision for a maintenance of an electrical conductivity along a full length of said electrical circuit during a relative re-positioning of said socket and plug assembly components at any point within their said rotation around their said long axis of rotation;

said snug but non-fixed fit between said internal aspect of said socket and said external aspect of said rod section providing for a creation of a frictional adherence between said plug and socket components, which said adherence creates a frictional resistance of a strength adequate for a prevention of an unintended separation of said slip coupling elements during a full range of use of said tool in differing positions, levels and angulations of use for any intended use of said tool while still providing of an allowance and an ease of a manual uncoupling of said slip coupling elements when such a separation of said slip coupling elements is desired;

said non-fixed but snug fit between said internal aspect of said socket and said external aspect of said rod section further creating a provision for an automatic separation of said slip coupling elements when an applied tractional force along a length of said electrical circuit components of said electrical circuit exceeds said frictional resistance of said slip coupling elements of said device;

said automatic separation allowing thereby an interruption of said electrical current flow in said electrical circuit without a damage to any components of said circuit;

once an over-tractioning of said components of said circuit is eliminated, an immediate re-establishment of said electrical current flow within said circuit can be re-established once said secondary socket and plug element components are again brought into a fully paired engagement.

2. The device of claim 1 in which said ring shaped electrically conductive elements of said socket assembly comprise a set of needle bearings.

3. The device of claim 1 in which said ring shaped electrically conductive elements of said socket assembly comprise a set of conductive rings selected from the group consisting of non-threaded, tubular shaped, copper fittings, copper tubing, steel tubing, steel fittings.

* * * * *